US006910955B2

(12) United States Patent
Wang et al.

(10) Patent No.: US 6,910,955 B2
(45) Date of Patent: Jun. 28, 2005

(54) ROTARY DRIVE DEVICE OF A POLISHING DEVICE

(75) Inventors: Hong You Wang, Mie-ken (JP); Koji Kawashima, Mie-ken (JP)

(73) Assignee: Teijin Seiki Co., Ltd., Tokyo (JP)

( * ) Notice: Subject to any disclaimer, the term of this patent is extended or adjusted under 35 U.S.C. 154(b) by 0 days.

(21) Appl. No.: 09/811,417

(22) Filed: Mar. 20, 2001

(65) Prior Publication Data

US 2002/0094763 A1 Jul. 18, 2002

(30) Foreign Application Priority Data

Mar. 27, 2000 (JP) ..... 2000-086061
Feb. 13, 2001 (JP) ..... 2001-036083

(51) Int. Cl.[7] ..... B24B 7/00
(52) U.S. Cl. ..... 451/67; 451/259; 451/285
(58) Field of Search ..... 451/41, 67, 285, 451/287, 288, 290, 259–261

(56) References Cited

U.S. PATENT DOCUMENTS 4,483,216 A * 11/1984 Takahashi et al. ..... 475/195
6,280,304 B1 * 8/2001 Nakamura et al.

FOREIGN PATENT DOCUMENTS

JP 62-78260 A 5/1987
JP 8-167585 A 6/1996

* cited by examiner

*Primary Examiner*—Hadi Shakeri
(74) *Attorney, Agent, or Firm*—Rothwell, Figg, Ernst & Manbeck

(57) ABSTRACT

A polishing device having a table connected to a traction drive type reduction gear. The reduction gear includes an externally contacting shaft formed in a ring-shaped hollow cylinder and arranged at the center; a plurality of intermediate shafts which are equidistantly disposed at the circumference of the externally contacting shaft, at least one of which is an input shaft; and an internally contacting cylinder with which the intermediate shafts internally contact, and under free conditions, the externally contacting shaft formed in a hollow cylinder has a diameter which is a little bit larger than a diameter of an imaginary circle which externally contacts with a plurality of intermediate shafts whereby pressing load is created by means of deformation of the hollow cylinder.

15 Claims, 5 Drawing Sheets

ROTARY DRIVE DEVICE OF A POLISHING DEVICE

BACKGROUND OF THE INVENTION

1. Field of the Invention

The present invention relates to a rotary drive device of a polishing device. More specifically, the present invention relates to a rotary drive device of a polishing table, a table for CMP (Chemical Mechanical Polishing) or polisher which is used to flatten an end face of a semiconductor wafer or an end face of liquid crystal glass.

2. Description of Related Art

Conventionally, a method called CMP (Chemical Mechanical Polishing) is used to flatten semiconductor wafers and so on. In short, a wafer is put on a turn table, then, the wafer is pushed to the turn table by a polisher and is polished thereby having slurry sprayed between the wafer and turn table (for example, see Japanese Patent Laid-Open No. Hei 8-167585).

It is necessary to drive this turn table and/or the polisher at low vibration and with low noise, and accordingly a direct drive motor of a low rotating speed, which will be referred to as DD motor hereinbelow, is widely used for this purpose. In other words, a drive shaft locating at the center of the turn table is coupled with an output shaft of the DD motor. However, in that case of conventional DD motor system, there was a problem that it is voluminous and heavy.

In addition, as wafer size increases (for example, from 8 inches to 12 inches), a still bigger torque is needed to drive a table. Because of this, the problem intensifies more. More specifically, in order to obtain a large torque, a volume and weight of a DD motor increase, and thus, a necessary electric current becomes big, and the generation of heat increases.

On the other hand, in order to obtain an evenness of high dignity in a wafer, it is an important problem for CMP that changes and vibration in a rotational speed of a table are suppressed strictly. However, absolute amount of change in the rotational speed of a motor is generally almost fixed. In addition, a change rate of the motor speed is determined as a rate of a change relative to the motor speed. Because of these reasons, it is difficult for a DD motor, the rotational speed of which is low, to suppress a change rate of speed at low level.

In order to overcome this problem, there is a proposal wherein a high-speed motor and a gear type reduction gear are employed, and miniaturization of the drive is planned, and, at the same time, a change rate of speed is decreased. For example, a drive shaft is downwardly disposed from the center of a turn table, a gear formed on this drive shaft and a gear mounted on the output shaft of a drive motor are engaged with each other so that the turn table is rotatably driven (for example, see Japanese Utility Model Laid-Open No. Sho 62-78260). However, there is a problem that comparatively large vibration and noise occur because of engagement between teeth in the gear type reduction gear.

Problems to be Solved by the Invention

As described above, as for the drive of CMP tables or the like, required torque increases as the diameter of a wafer increases. On the other hand, polishing devices of semiconductor wafers are generally used in a clean room, their lightweighting is required from a limit against load of a clean room floor.

In addition, for rotation of a polishing table, a table for CMP or a polisher, high rotational precision is required strictly (i.e., small change of a rotational speed, small vibration, small fluctuation of a table surface) in order to highly precisely flatten a wafer.

Furthermore, a polishing table, a table for CMP or a polisher is required to scarcely generate low heat and have a hollow structure in order to control the temperature of the polishing table, the table for CMP or the polisher.

BRIEF SUMMARY OF THE INVENTION

Objects of the Invention

It is an object of the present invention to provide a rotary drive device of a polishing device, i.e., a rotary drive device of a polishing table, a table for CMP (Chemical Mechanical Polishing) or a polisher, which can simultaneously satisfy the above-described demands.

It is another object of the present invention to provide a drive of a polishing, table for CMP or a polisher, which has a large output torque and high rotational speed precision, which performs low vibration, and low noise, and which has a hollow, compact and lightweight structure.

Means to Solve the Problems

According to the present invention, the objects are achieved by a rotary drive device of a polishing device such as a polishing table, a table for CMP or a rotary drive device of a polisher which is used to flatten an end face of a semiconductor wafer or an end face of liquid crystal glass, wherein a traction drive type reduction gear, which comprises: an externally contacting shaft; and a plurality of intermediate shafts which are equidistantly disposed at the circumference of and which are externally contacting with the externally contacting shaft, is used to transmit the rotation to the polishing table, the table for CMP or the polisher.

More specifically, as shown in the illustrated embodiment, it is preferred that the present invention is carried out as a rotary drive device of a polishing device wherein a traction drive type reduction gear comprises: an externally contacting shaft formed in a ring-shaped hollow cylinder and arranged at the center; a plurality of intermediate shafts which are equidistantly disposed at the circumference of the externally contacting shaft, and at least one of which is an input shaft; and an internally contacting cylinder with which the intermediate shafts internally contact, and under free conditions, the externally contacting shaft formed in a hollow cylinder has a diameter which is a little bit larger than a diameter of an imaginary circle which externally contacts with a plurality of intermediate shafts whereby pressing load is created by means of deformation of the hollow cylinder.

In this case, it is preferred that the internally contacting cylinder is formed in co-axially arranged double hollow rings, and that an inside ring and an outside ring of the double hollow rings are coupled with each other by means of a coupling member.

More specifically, the internally contacting cylinder has a plurality of recesses, and is integrally engaged with the outside ring (output shaft) of the double hollow rings sandwiching rollers mounted in the recesses therebetween. According to this construction, the shape of the floating ring (hollow ring-shaped internally contacting cylinder) which has been in a truth circle is deformed in a wavy shape in the elastic region whereby pressing force is generated. Thus, the rotation of the polishing table, the table for CMP or the polisher can achieve high rotation precision (change of a rotational speed, vibration, fluctuation of the table surface being small), and the wafers can be processed in a highly precision.

Furthermore, as illustrated in the embodiment, according to the present invention, it is preferred that the internally contacting cylinder is coupled with the polishing table, the table for CMP or the polisher by means of a pin or a key. More concretely, it is preferred that the internally contacting cylinder is formed in an inner race of the main bearing, the main bearing being formed by two lines of angular ball bearings, and the outer race of the main bearing is integrated with a housing of the polishing device. Thus, the structure becomes compact, and as a polishing device of semiconductor wafers installed in a clean room, lightweighting can be achieved while a limit against load of a clean room floor can be born.

Furthermore, as illustrated in the embodiment, according to the present invention, an electric motor may be coupled with an input shaft, and the input shaft may be offset more greatly than a radius of the electric motor from the center of the externally contacting shaft, so that the polishing table, the table for CMP or the polisher can be formed in a hollow structure, and that temperature of the polishing table, the table for CMP or the polisher can be controlled readily.

In addition, as illustrated in an alternative embodiment, the present invention may be a rotary drive device of a polishing device which comprises: an externally contacting shaft which is disposed at the center and which serves as an input shaft; a plurality of intermediate shafts equidistantly disposed at the circumference of the externally contacting shaft; an internally contacting cylinder with which the intermediate shafts internally contact; and a carrier which it rotatably supports the intermediate shafts, and the output is taken out from the carrier or the internally contacting cylinder.

In this case, it is preferred that the externally contacting shaft is offset from the rotational center of the polishing table, the table for CMP or the polisher, an output shaft coupled with the carrier is disposed on an axis of an externally contacting shaft and the output shaft is coupled with the polishing table, the table for CMP or the polisher by means of a power transmission member. Tooth belts can be used as the power transmission member. In addition, an electric motor may be coupled with the externally contacting shaft which serves as an input shaft.

As described above, a DD motor has a large volume and weight. In order to obtain large torque, necessary electric current is big and the generation of heat increases. Contrary to this, according to the present invention, a high-speed motor (more than 1,000 rpm) is employed, and an output torque is taken out after it is magnified by a reduction ratio R times using a reduction gear of special structure, and thus the device can be compact while it creates a large torque.

In addition, as described above, in a polishing table, a table for CMP or a polisher, it is an important problem to strictly suppress a change and vibration of a rotational speed of a table in order to obtain an evenness of high dignity in a wafer. According to the present invention, this problem can be solved by using a special reduction gear which has the structure described above.

BRIEF DESCRIPTION OF THE SEVERAL VIEWS OF THE DRAWINGS

The present invention will now be explained in detail with reference to the drawings illustrating some embodiments of the present invention, wherein.

DETAILED DESCRIPTION OF THE INVENTION

Figure 1:
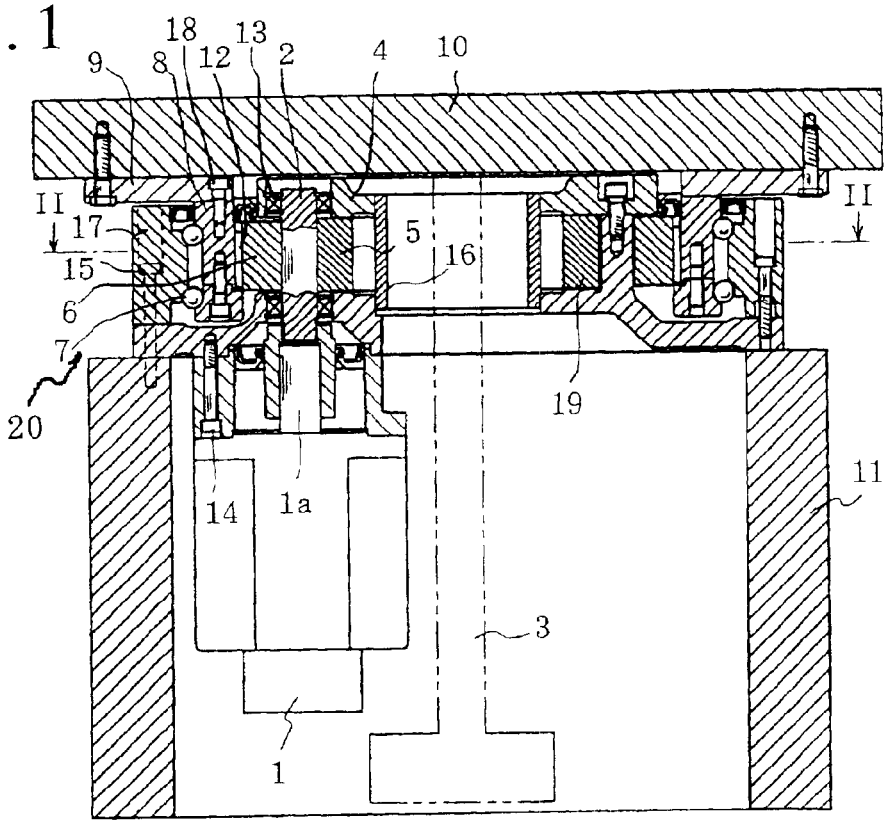
FIG. 1 shows a sectional view of one embodiment wherein the present invention is carried out in a CMP table.

In a preferred embodiment illustrated in FIG. 1, reference numeral 10 denotes a table, on which semiconductor wafers or liquid crystal glass are mounted and which is pushed by polisher (not shown) from the top, and it is used to flatten an end face of the wafers or an end face of liquid crystal glass. The table 10 is disposed on a frame 11 and, as will be described later, it can be rotated in a horizontal plane by a drive motor through a traction drive type reduction gear 20.

Figure 2:
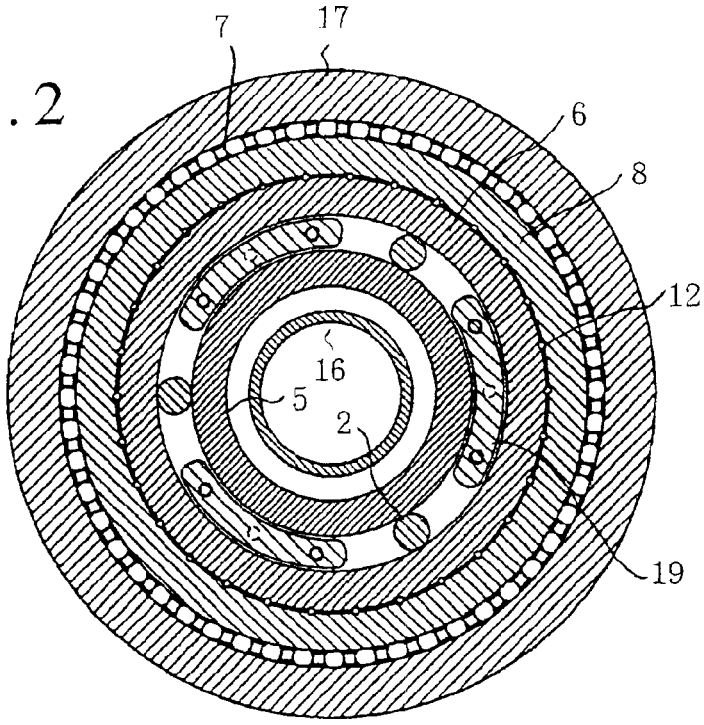
FIG. 2 shows 2—2 section of FIG. 1.

Referring to FIG. 2, an embodiment of a rotary drive device according to the present invention will be explained. An externally contacting shaft 5 formed in a ring-shaped hollow cylinder is disposed at the rotational center of the table 10 by means of a carrier 4 (FIG. 1). A plurality of (3 in FIG. 2) intermediate shafts 2 are equidistantly disposed at the circumference of the externally contacting shaft 5, and as illustrated in FIG. 1, they are supported rotatably on the carrier 4 by means of bearings 13. Each intermediate shafts 2 externally contacts with the externally contacting shaft 5. Therefore, each axis of the intermediate shafts 2 is offset from the axis of the externally contacting shaft 5 formed in a ring-shaped hollow cylinder. The amount of this offset is set larger than a radius of a drive motor 1 which will be described later.

As illustrated in FIG. 1, the drive motor 1 which is an electric motor is mounted on frame 11 by means of bolts 14, and the output shaft 1*a* of the drive motor 1 is vertical. One of the intermediate shafts 2 is coupled with the output shaft 1*a* of the drive motor 1 by spline (not illustrated), and the intermediate shaft 2 is an input shaft of the CMP table.

As described above, the position of the intermediate shafts 2 is offset more than the radius of the drive motor 1, and the externally contacting shaft 5 formed in an ring-shaped hollow cylinder is located at the center of the table, and a thin cylinder 16 is supported by the carrier 4 at the center of the table 10 to form a hollow structure. A joint 3 is passed through the hollow portion to control the temperature of the polishing table, the table for CMP or the polisher.

Referring to FIG. 2 again, the outer circumference of the above described plurality of intermediate shafts 2 internally contact with the internal circumference of the internally contacting cylinder 6. In the present embodiment, the output shaft 8 formed in a hollow ring and co-axial with the internally contacting cylinder 6 is disposed outside of the internally contacting cylinder 6, and thus, co-axial double hollow rings is formed by the internally contacting cylinder 6 and the output shaft 8.

A lot of recesses are formed at corresponding positions of the outer circumferential surface of the inside ring (internally contacting cylinder 6) and the internal circumference surface of the outside ring (output shaft 8) of the double hollow rings, and a lot of rollers 12 are mounted in the recesses formed on the inside ring (internally contacting cylinder 6) and the outside ring (output shaft 8) as a coupling member. Therefore, the inside ring (internally contacting cylinder 6) and the outside ring (output shaft 8) are coupled with each other by the rollers 12, and thus, deformation in a radial direction of the inside ring (internally contacting cylinder 6) is permitted while the double hollow rings comprising the outside ring (output shaft 8) and the inside ring (internally contacting cylinder 6) are united with respect to its rotation.

The externally contacting shaft 5 formed in a ring-shaped hollow cylinder is held by a plurality of intermediate shafts 2 without being disposed with special support bearing, and it forms a floating ring. The diameter of the externally contacting shaft 5 of the hollow cylinder is set a little bit larger than a diameter of an imaginary circle which externally contacts with the intermediate shafts 2 under free conditions, so that in the installation state wherein the externally contacting shaft 5 of the hollow cylinder, the intermediate shafts 2 and the internally contacting cylinder 6 are installed, pressing load is generated by means of deformation of the externally contacting shaft 5 and internally contacting cylinder 6 of the hollow cylinder.

The outside ring (output shaft 8) of the double hollow rings serves as an inner race of the main bearing, and case 17 serves as an outer race of the main bearing. Therefore, the main bearing consisting of two lines of vertically disposed angular ball bearings is formed by means of the outside ring (output shaft 8), the case 17 and the bearing balls 7 mounted therebetween. As a result, the outside ring (output shaft 8) coupled with the inside ring (internally contacting cylinder 6) by means of the rollers 12 can rotate relative to the case 17.

The case 17 is fixed to the above described frame 11 by means of pins or keys 15. On the other hand, the outside ring (output shaft 8) is mounted on the above described table 10 by means of a flange 9 and bolts 18. Reference numeral 19 denotes a support member which is disposed between the adjacent intermediate shafts 2 and which raises rigidity of the carrier 4.

In the embodiment of the present invention which has the above-described structure, the internally contacting cylinder 6 and externally contacting shaft 5 are formed in a ring-shaped hollow cylinder, and form a floating structure which permits free deformation, within the elastic region. In other words, the hollow cylinder is supported by the intermediate shafts without support of any bearings. Materials and size of the externally contacting shaft 5 and the internally contacting cylinder 6, are so selected that desired pressing force is produced by their external or internal contact with the intermediate shafts 2 and that fatigue does not occur by repeated stress.

More specifically, since the externally contacting shaft 5 acts as one of the floating rings, the outer diameter of this floating ring (hollow externally contacting shaft 5) is formed a little bit larger than a diameter of an imaginary circle which externally contacts with the intermediate shafts 2. This floating ring is built in at the center so that it externally contacts with a plurality of intermediate shafts 2. By this construction, the shape of the floating ring (hollow externally contacting shaft 5) which has been a truth circle is changed into wavy shape in the elastic region, and pressing force is generated. In this case, the number of waves created by deformation of the floating ring becomes equal to that of the intermediate shafts 2.

Further, since the internally contacting cylinder 6 serves as the other floating ring, the inside diameter of this floating ring (hollow ring-shaped internally contacting cylinder 6) under free conditions is get to be a little bit smaller than a diameter of the imaginary circle with which a plurality of intermediate shafts 2 internally contact. This floating ring is built in at the outside of the intermediate shafts 2 so that a plurality of intermediate shafts 2 internally contact with the floating ring.

When the drive motor 1 is rotated, the rotation of the output shaft 1*a* is transmitted to the intermediate shafts 2, and the rotation of the intermediate shafts 2 is transmitted to the internally contacting cylinder 6 by means of traction force, and the torque of the intermediate shafts 2 is increased by a ratio between the radiuses of the internally contacting cylinder 6 and the intermediate shafts 2. In this case, because there is no engagement between teeth and teeth in the present embodiment, smooth reduced rotation can be realized.

Further, as illustrated in FIG. 2, the load which is generated by propping of the externally contacting cylinder (externally contacting shaft) 5 against intermediate shafts 2 and the load generating by squeezing of the internally contacting cylinder 6are balanced with each other, so that the intermediate shafts 2, the externally contacting cylinder (externally contacting shaft) 5 and the internally contacting cylinder 6 are kept in a balanced state. Because internally applied pressing load does not exert excessive unbalanced force or deformation to a base supporting the intermediate shafts 2 and the main bearing, vibration and the noise of the whole device is remarkably decreased.

Furthermore, as measures of the worry that the rotation precision deteriorates due to pressing force created by deformation of the externally contacting shaft 5 locating at the center and acting on the intermediate shafts 2 and the internally contacting cylinder 6 and due to the vibration of the internally contacting cylinder 6, in the present embodiment, the internally contacting cylinder 6 may be formed in co-axial double hollow rings, and the inside ring 6 and the outside ring 8 of the double hollow rings may be coupled with each other by a coupling member (rollers 12). By this construction, deformation of the inside ring caused by the deformation of externally contacting shaft 5 formed in a ring-shaped hollow cylinder is scarcely transmitted to the outside ring, and accordingly, the rotation precision of the internally contacting cylinder 6 improves.

More specifically, because pressing load for obtaining a traction force is not transmitted to the base and the casing, even if the main bearing is disposed at neighborhood of the traction mechanism, a flat type drive is provided without giving adverse influence to rotation precision of the main bearing.

Furthermore, an electric motor is offset more than a radius of the motor from the central axis of the reduction gear so as to form a hollow structure. Temperature control can be simply done by passing a joint for controlling the temperature of a table through the hollow portion.

The inner race and the outer race of the main bearing for a rotation of the table are formed integrally with the casings of the output shaft, respectively, because of thick wall, high precision and high rigidity can be realized.

Because of the construction described above, a rotary drive device of a polishing table, a table for CMP (Chemical Mechanical Polishing) or a polisher which exerts a large output torque and high rotational speed precision, as well, which has a hollow structure of lightweight and compact while it generates low vibration, low noise, is provided. More specifically, a compact rotary drive device of a polishing device having superior rotation stability relative to the conventional devices can be realized.

Figure 3:
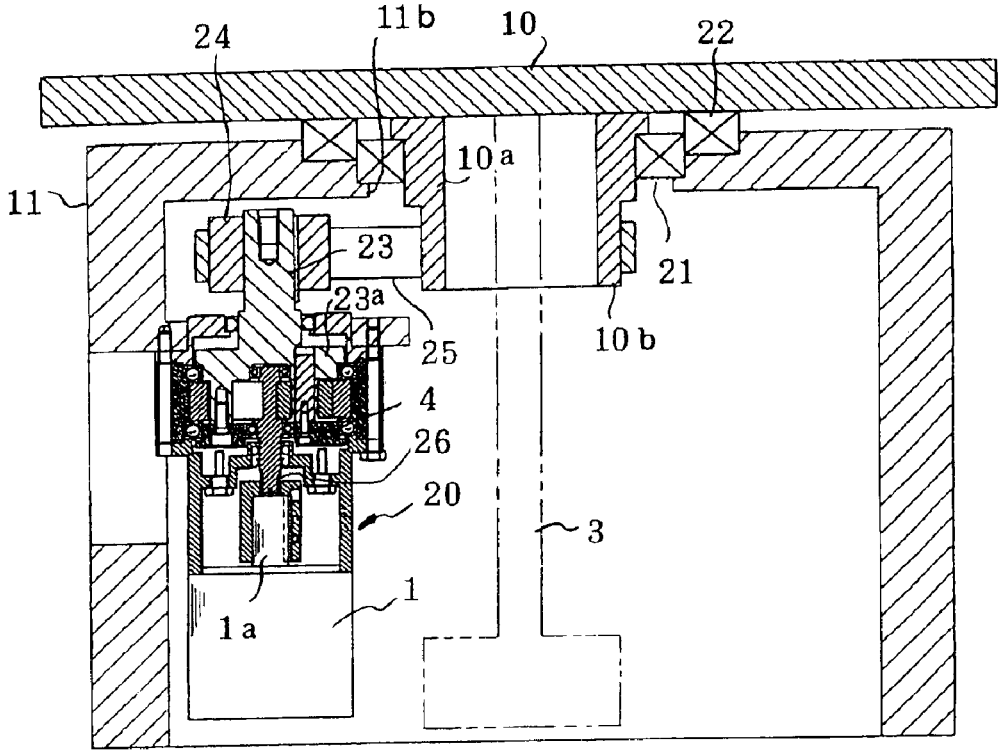
FIG. 3 shows a sectional view of the alternative embodiment wherein the present invention is carried out in a CMP table.
Figure 4:
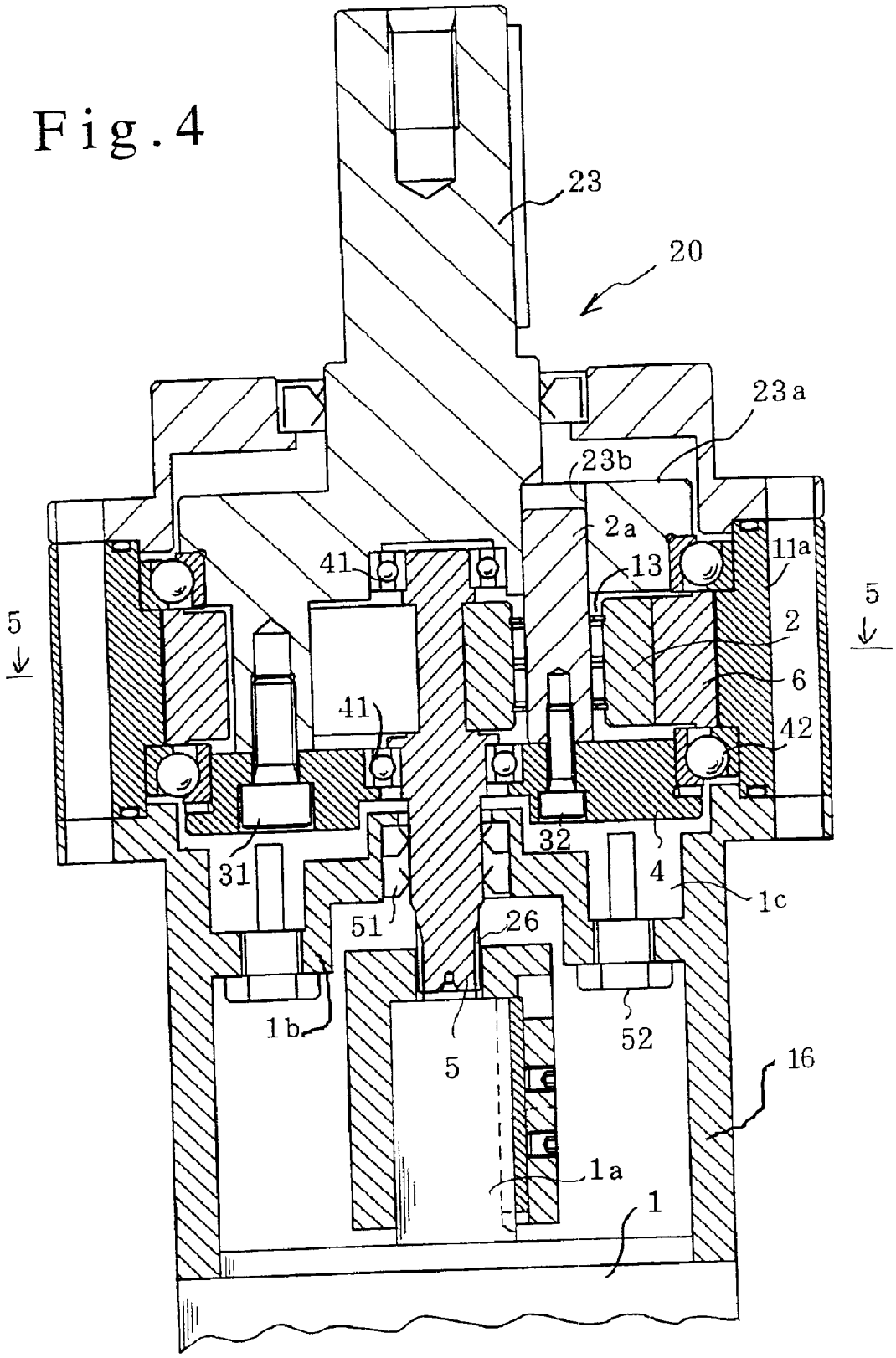
FIG. 4 shows an enlarged sectional view of a traction drive type reduction gear used in the embodiment of FIG. 3.
Figure 5:
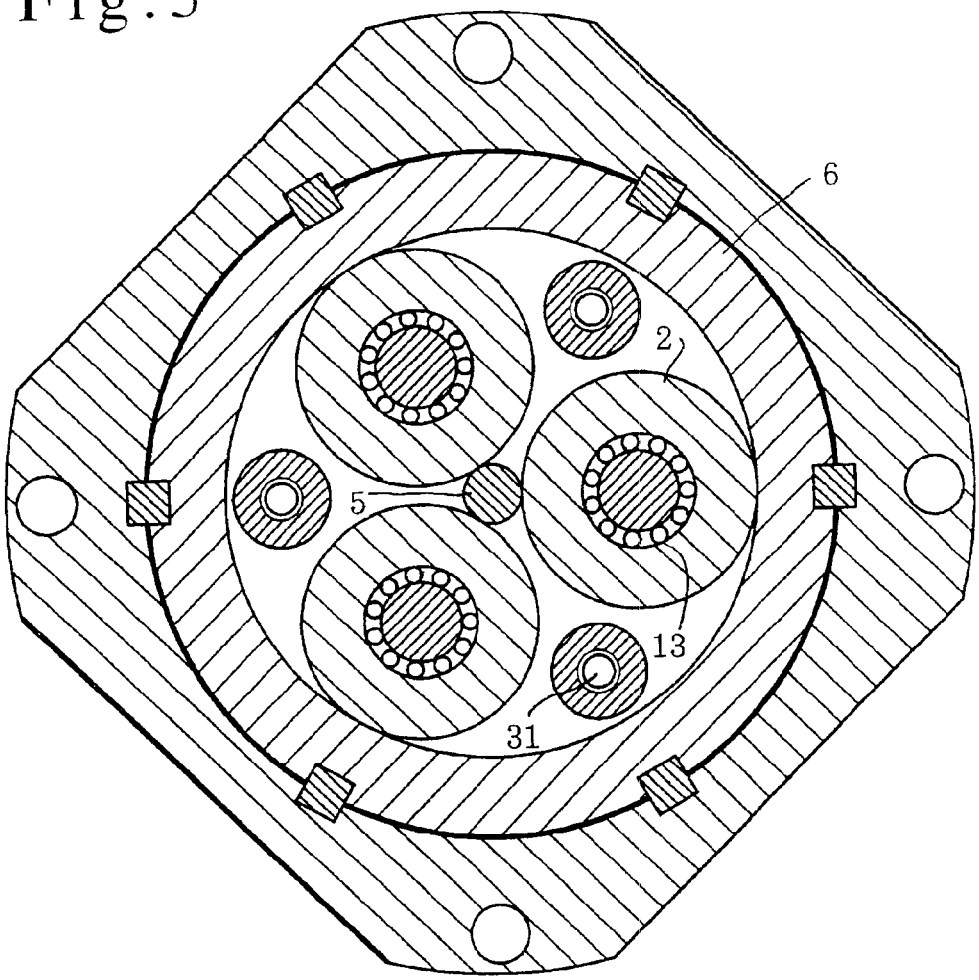
FIG. 5 shows 5—5 section of FIG. 4.

An alternative embodiment of the present invention will now be explained. FIG. 3 is a sectional view of the alternative embodiment wherein the present invention is carried out in a CMP table, FIG. 4 is an enlarged sectional view of a traction reduction gear used in FIG. 3, and FIG. 5 shows 5—5 section of FIG. 4.

In FIG. 3, a table 10 is formed in a circular disc, on which semiconductor wafers or liquid crystal glass are mounted, it is pressed down by a polisher (not shown) from the top, and it is used to flatten an end face of wafers or an end face of liquid crystal glass. Reference numeral 11 denotes a frame.

A hollow shaft 10*a* protrudes downward from the center of the table 10. A radial bearing 21 is mounted between the hollow shaft 10*a* and the aperture 11*a* of the frame 11, and a thrust bearing 22 is mounted between the lower surface of the table 10 and the upper surface of the frame 11. Thus, the table 10, is disposed on the frame 11 rotatably about a vertical axis via the radial bearing 21 and the thrust bearing 22.

In the inside of the frame 11, a traction drive type reduction gear 20 is arranged at a position offset from the center of the aperture 11*a*, and a drive motor 1 is coupled with the traction drive type reduction gear 20.

A hollow pulley 10*b* is formed at a bottom end of the hollow shaft 10*a* of the above described frame 11, and the output shaft 23 of the traction drive type reduction gear 20 has a solid pulley 24 mounted thereon. A transmission member 25, such as a tooth belt, is engaged between the hollow pulley 10*b* and the solid pulley 24. Therefore, the table 10, is rotated in a horizontal plane by the drive motor 1 via the traction drive type reduction gear 20 and the transmission member 25.

The offset amount of the disposed position of the traction drive type reduction gear 20 is set larger than a bigger one among the radius of the traction drive type reduction gear 20 and the radius of the drive motor 1, and thus, the lower part of the aperture 11*a* formed in the frame 11 is open so that a joint 3 can be passed through the aperture 11*a* formed in the frame 11 and so that the temperature of the polishing table, the table for CMP or the polisher can be controlled.

Referring to FIGS. 4 and 5, the details of the traction drive type reduction gear 20 of the present embodiment will now be explained. The output shaft 1*a* of the drive motor 1 has an externally contacting shaft 5 coupled therewith by spline, and the externally contacting shaft 5 is located co-axially with the output shaft 1*a*.

On the other hand, the output shaft 23 of the traction drive type reduction gear 20 is formed in a disc-shape at the bottom end 23*a* thereof. Further, the carrier is also formed in a disc-shape. The disc-shaped bottom end 23*a* of the output shaft 23 and the disc-shaped carrier 4 are coupled with each other by means of bolts 31.

The externally contacting shaft 5 of traction drive type reduction gear 20 is rotatably supported on the output shaft 23 and the carrier 4, which are coupled unitedly as described above, by means of the upper and lower bearings 41, and it is located at the rotational center of traction drive type reduction gear 20.

The disc-shaped bottom end 23*a* of the output shaft 23 has a plurality of (3 in FIG. 5) bores 23*b* formed equidistantly at the circumference thereof. The head of the support shaft 2*a* for the intermediate shafts are inserted into the bores 23*b*, and the bottom ends of the support shafts 2*a* for the intermediate shafts are fixed to carrier 4 by bolts 32. Between output shaft 23 and carrier 4, a plurality of (3 in FIG. 5) support shafts 2*a* for the intermediate shafts are equidistantly disposed at the circumference of the externally contacting shaft 5. The intermediate shafts 2 are rotatably supported on the support shaft 2*a* for the intermediate shafts via bearings 13, and each intermediate shafts 2 externally contacts with the externally contacting shaft 5.

The outer circumferences of a plurality of intermediate shafts 2 internally contact the internal circumference of the internally contacting cylinder 6. In the present embodiment, the internally contacting cylinder 6 is fixed to frame 11 via the support member 11*a*. The output shaft 23 and the carrier 4, which are coupled unitedly as described above, are supported rotatably on the inside of the support member 11*a* via the upper and lower bearings 42.

An oil seal 51 is arranged between the externally contacting shaft 5 and the drive motor cover 1*b* at a position between the spline coupling 26 and the lower bearing 41. Further, the drive motor cover 1*b* has a recess 1*c* formed at the radial outside of the oil seal 51 so that storage of abrasion powder generated in traction drive type reduction gear 20 is formed. Reference numeral 52 denotes a bolt which can be engaged and disengaged, and when the bolt 52 is disengaged, abrasion powder collected in the recessed storage 1*c* can be removed.

Figure 6:
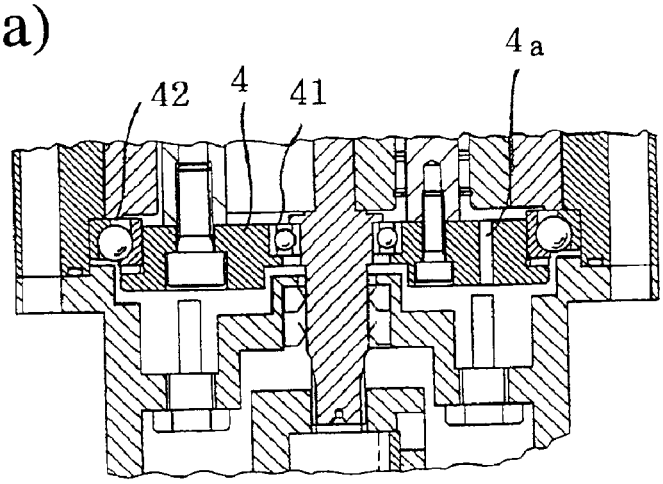
FIGS. 6(*a*)–(*c*) show fragmentary sectional views of different embodiments of a traction drive type reduction gear.
Figure 6:
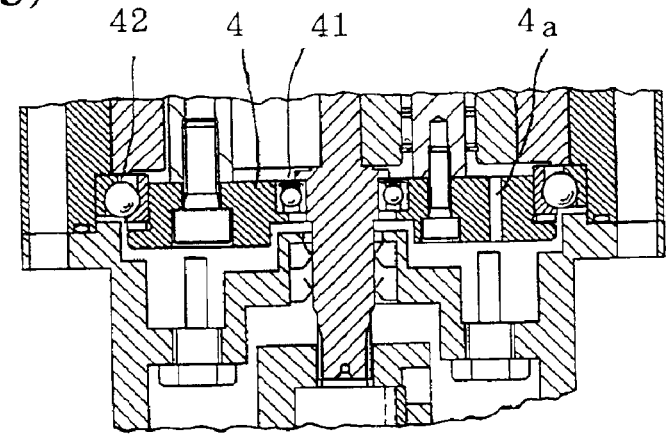
Figure 6:
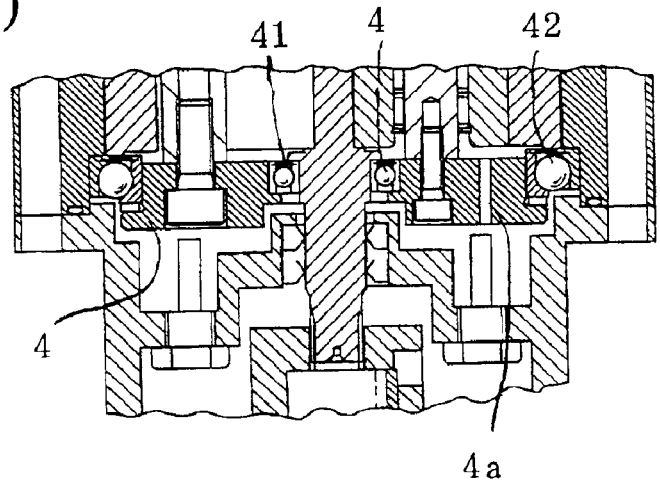

The lower inside bearing 41 may be a bearing with seal while a bearing without seal is used as the lower outside bearing 42, alternatively as illustrated in FIG. 6(*a*), both the bearings 41 and 42 may be bearings which have no seals while bores 4*a* for the abrasion powder passage are formed in the carrier 4, so that abrasion powder moves to recessed storage 1*c* without damaging oil seal 51. Furthermore, as illustrated in FIG. 6(*b*), bores 4*a* for abrasion powder passages may be formed in the carrier 4 while bearing with seal is used as the lower inside bearing 41 while the lower outside bearing 42 is a bearing without seal, and alternatively, as illustrated in FIG. 6(*c*), both the bearings 41 and 42 are bearings with seal.

In the present embodiment, rotation of the output shaft 1*a* of drive motor 1 is transmitted to the externally contacting shaft 5 of the traction drive type reduction gear 20. In this occasion, since the internally contacting cylinder 6 is fixed to the frame 11, the rotation of the externally contacting shaft 5 is decelerated, and it is transmitted to the output shaft 23 through the intermediate shafts 2 of the traction drive type reduction gear 20 and the internally contacting cylinder 6. The rotation is transmitted to the hollow pulley 10*b* from the solid pulley 24 mounted on the output shaft 23 through the transmission member 25 such as a tooth belt, and the table 10 is rotated in a horizontal plane.

Because of the construction described above, a rotary drive device for a polishing table, a table for CMP (Chemical Mechanical Polishing) or a polisher is provided which generates a large output torque and high rotational speed precision, as well low vibration and low noise, which has a hollow structure, and which is lightweight and compact. In other words, provided is a rotary drive device of a polishing device having superior rotation stability and being compact compared to the conventional devices.

According to the present invention, unexpected advantages achieved that the number of throughput can be increased by means of improvement of pressure force of abrasion with increase of a rotation torque of a CMP table, and thus, productivity can be improved, and that floor space for installation can be reduced because it is so compact that it is completely stored under a table. By lightweighting, pressure to the clean room bed that has comparatively low limit against load can reduce, and low cost can be realized. Stability of superior rotation highly contributes to a uniform flattening of wafer greatly, and the performance of a CMP table drive is improved remarkably.

The traction drive type reduction device (gear) which is applicable to the present invention may be not only of a traction type wherein power is transmitted by friction force via lubricating oil but also of a friction drive type wherein power is transmitted by friction force without using lubricant, and the scope of the present invention includes both the types.

What is claimed is:

1. A polishing device comprising:

a table provided with hollow space beneath the central portion of the table;

a traction drive type reduction gear driving said table; and a driving motor coupled with the reduction gear and disposed offset from the central rotational axis of the table:

said reduction gear comprising:

a center;

an externally contacting shaft arranged at said center;

a plurality of intermediate shafts disposed equidistantly at a circumference of the externally contacting shaft, said intermediate shafts externally contacting the externally contacting shaft; and an internally contacting cylinder with which the intermediate shafts internally contact and which is formed in a co-axially arranged hollow ring;

wherein at least one of the intermediate shafts is an input shaft.

2. The polishing device of claim 1, wherein said externally contacting shaft is formed in a ring-shaped hollow cylinder; and under free conditions, the externally contacting shaft has a diameter which is a little bit larger than a diameter of an imaginary circle which externally contacts with the plurality of intermediate shafts whereby pressing load is created by means of deformation of the externally contacting shaft.

3. The polishing device according to claim 1, wherein the internally contacting cylinder is coupled with the table by means of at least one of a pin or a key.

4. The polishing device according to claim 1, wherein the internally contacting cylinder is formed in an inner race of the main bearing.

5. The polishing device according to claim 4, wherein the main bearing is formed by two lines of angular ball bearings, and the outer race of the main bearing is integrated with a housing of the polishing device.

6. The polishing device according to claim 1, wherein an electric motor is coupled with the input shaft, and the input shaft is offset more greatly than a radius of the electric motor from the center of the externally contacting shaft.

7. A polishing device comprising:

a table provided with hollow space beneath the central portion of the table;

a traction drive type reduction gear driving said table; and a driving motor coupled with the reduction gear and disposed offset from the central rotational axis of the table:

said reduction gear comprising:

a center;

an externally contacting shaft arranged at said center;

a plurality of intermediate shafts disposed equidistantly at a circumference of the externally contacting shaft, said intermediate shafts externally contacting the externally contacting shaft; and an internally contacting cylinder with which the intermediate shafts internally contact and which is formed in a co-axially arranged hollow ring;

wherein the internally contacting cylinder is formed in co-axially arranged double hollow rings, and that an inside ring and an outside ring of the double hollow rings are coupled with each other by means of a coupling member;

wherein the externally contacting shaft is an input shaft; and wherein a carrier rotatably supports the intermediate shafts, and output is taken from the carrier.

8. A polishing device comprising:

a table;

a traction drive type reduction gear driving said table, said reduction gear comprising:

a center;

an externally contacting shaft arranged at said center;

a plurality of intermediate shafts disposed equidistantly at a circumference of the externally contacting shaft, said intermediate shafts externally contacting the externally contacting shaft; and an internally contacting cylinder with which the intermediate shafts internally contact;

said externally contacting shaft being an input shaft;

a carrier rotatably supports the intermediate shafts, and output is taken from the carrier; and the externally contacting shaft is offset from the rotational center of the table, and an output shaft coupled to the carrier being disposed on an axis of an externally contacting shaft, and the output shaft being coupled with the table by means of a power transmission member.

9. The polishing device according to claim 8, wherein an electric motor is coupled with the externally contacting shaft.

10. A polishing device comprising:

a table provided with hollow space beneath the central portion of the table;

a traction drive type reduction gear driving said table; and a driving motor coupled with the reduction gear and disposed offset from the central rotational axis of the table:

said reduction gear comprising:

a center;

an externally contacting shaft arranged at said center;

a plurality of intermediate shafts disposed equidistantly at a circumference of the externally contacting shaft, said intermediate shafts externally contacting the externally contacting shaft; and an internally contacting cylinder with which the intermediate shafts internally contact and which is formed in a co-axially arranged hollow ring;

wherein the internally contacting cylinder is formed in co-axially arranged double hollow rings, and that an inside ring and an outside ring of the double hollow rings are coupled with each other by means of a coupling member; and wherein at least one of the intermediate shafts is an input shaft.

11. The polishing device of claim 10, wherein the externally contacting shaft is an input shaft.

12. The polishing device of claim 10, wherein said polishing device is a polishing table.

13. The polishing device of claim 10, further comprising a support member, wherein the internally contacting cylinder and the support member form double hollow rings.

14. A polishing device comprising:

a table; and a traction drive type reduction gear driving said table, said reduction gear comprising:

a center;

an externally contacting shaft arranged at said center;

a plurality of intermediate shafts disposed equidistantly at a circumference of the externally contacting shaft, said intermediate shafts externally contacting the externally contacting shaft; and an internally contacting cylinder with which the intermediate shafts internally contact;

said externally contacting shaft being an input shaft, a carrier rotatably supporting the intermediate shafts, and output being taken from the internally contacting cylinder.

15. A polishing device comprising a table provided with hollow space beneath the central portion of the table;

a traction drive type reduction gear driving said table; and a driving motor coupled with the reduction gear and disposed offset from the central rotational axis of the table:

said reduction gear comprising:

a center;

an externally contacting shaft arranged at said center;

a plurality of intermediate shafts disposed equidistantly at a circumference of the externally contacting shaft, said intermediate shafts externally contacting the externally contacting shaft;

an internally contacting cylinder with which the intermediate shafts internally contact and which is formed in a co-axially arranged hollow ring; and an output shaft, wherein the internally contacting cylinder and the output shaft form co-axially arranged double hollow rings.

* * * * *